US005119638A

United States Patent [19]

Cummings et al.

[11] Patent Number: 5,119,638

[45] Date of Patent: Jun. 9, 1992

[54] AIR CONDITIONING COMPRESSOR PROTECTION DEVICE

[75] Inventors: Larry D. Cummings, Clarence; Peter S. Eros, Williamsville, both of N.Y.

[73] Assignee: General Motors Corporation, Detroit, Mich.

[21] Appl. No.: 670,624

[22] Filed: Mar. 18, 1991

[51] Int. Cl.[5] ..... F25B 49/00; G01K 1/08

[52] U.S. Cl. ..... 62/126; 62/228.1; 123/41.15; 374/144

[58] Field of Search ..... 417/32; 62/129, 228.1; 123/41.15 V; 374/144

[56] References Cited

U.S. PATENT DOCUMENTS

| | | | |
|---|---|---|---|
| 2,978,879 | 4/1961 | Heidorn | 62/209 |
| 3,232,519 | 2/1966 | Long | 230/17 |
| 3,702,065 | 11/1972 | Jacobs | 62/158 |
| 4,059,366 | 11/1977 | Gannaway | 417/32 |
| 4,236,621 | 12/1980 | Mukai et al. | 192/82 |
| 4,596,518 | 6/1986 | Sumikawa | 417/269 |
| 4,704,072 | 11/1987 | Nakajima et al. | 417/223 |
| 4,733,175 | 3/1988 | Levinson | 374/137 X |
| 4,799,578 | 1/1989 | Matsushita | 192/84 |

FOREIGN PATENT DOCUMENTS 59-13137 1/1984 Japan .

*Primary Examiner*—William E. Wayner
*Attorney, Agent, or Firm*—Ronald L. Phillips

[57] ABSTRACT

A method of locating a limit switch (10) on a compressor (12) utilizes thermography for determining the optimum location thereof. A thermograph is produced for normal and abnormal operating modes of the compressor (12). High temperature gradients in the thermograph indicate high rates of temperature increases during compressor failure modes for selecting an optimum location for the limit switch. A bimetal switch (10) is utilized to establish a cut-out temperature for preventing operation of the compressor (12) and a cut-in temperature lower than the cut-out temperature for automatically closing to resume operation of the compressor (12) when returned to normal temperatures.

7 Claims, 4 Drawing Sheets

AIR CONDITIONING COMPRESSOR PROTECTION DEVICE

TECHNICAL FIELD

The invention relates to thermal protection devices for compressors used in cooling systems, and more particularly the determination of the location thereof.

BACKGROUND OF THE INVENTION

Thermal limiting devices which protect compressors from premature failure are generally known in the art. A variety of devices have been utilized to sense the thermal characteristics of the compressor, including multiple contacts, fuses, thermistors, and bimetallic switches.

U.S. Pat. No. 3,702,065, issued Nov. 7, 1972 in the name of Jacobs and assigned to the assignee of the subject invention, discloses an ambient temperature sensing switch and refrigerant superheat temperature responsive switch for an automobile air conditioning system having an electromagnetic clutch for transmitting engine rotation to a refrigerant compressor. The ambient temperature sensing portion of the switch is connected between the automobile battery and the coil of the clutch for energizing the coil whenever ambient temperatures are above a predetermined level. A thermistor in circuit with the refrigerant temperature responsive switch delays short circuiting of the clutch coil to prevent immediate blowing the fuse. The fuse will be permanently blown and must be replaced in order to once again energize the clutch of the compressor.

U.S. Pat. No. 4,059,366, issued Nov. 22, 1977 in the name of Gannaway discloses a thermal overload protective system for protecting the compressor. The thermal overload system eliminates the need for terminal seals typically employed because of the thermal switch positioning in the flow path of the gas. A thermistor is positioned in the body of at least one cylinder head of the compressor so as to be in good heat exchange relation with the gas being discharged but not directly exposed to the gas flow.

U.S. Pat. No. 4,704,072, issued Nov. 3, 1987 in the name of Nakajima et al, discloses a compressor with a rotation sensor disposed in the portion provided for mounting the magnetic clutch. The rotation sensor is comprised of a detectable portion corotatable with the drive shaft of the compressor and a detecting portion disposed on a cylindrical head in confronting relation to the detectable portion. The rotation sensor is disposed outside of the seal means disposed between the drive shaft and the cylinder head for providing a hermetic seal therebetween. The contact plates are made of thermally deflectable material such as shape memory alloy, a thermal metal or bimetal, so that when the ambient temperature exceeds a predetermined value, the plates expand radially outwardly from each other to thereby hold the detecting contacts out of engagement with the detectable contacts.

It is found that mixed results occur with the random placements of the limit switches. None of the prior art ensures safe operating conditions by reengaging the clutch only when the temperature decreases to the normal operating temperature.

SUMMARY OF THE INVENTION

The invention includes a method of positioning a limit switch on a compressor for measuring the temperature of the compressor and for allowing operation of the compressor during normal operation when the temperature thereof is less than a cut-in temperature and for preventing operation of the compressor during abnormal operations when the temperature thereof is greater than a cut-out temperature. The method includes the steps of operating a compressor near failure mode, measuring abnormal thermodynamics of the compressor, establishing a thermal differential location with respect to normal operation, and positioning the limit switch at the thermal differential location for sensing and controlling abnormal operation of the compressor.

BRIEF DESCRIPTION OF THE DRAWINGS

The invention will be better understood by reference to the detailed drawings wherein.

DESCRIPTION OF THE PREFERRED EMBODIMENT

Figure 1:
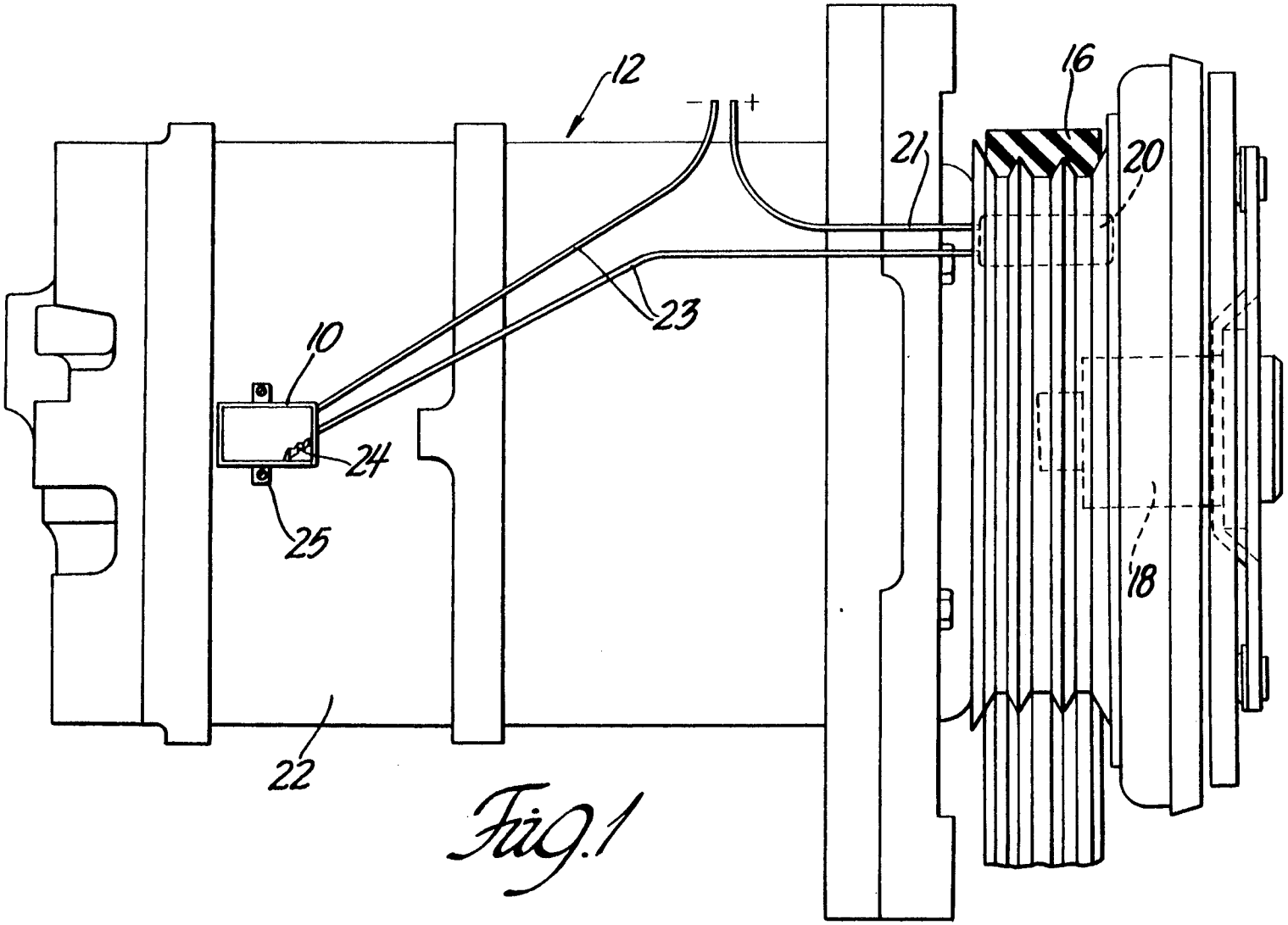
FIG. 1 is a perspective view of a first compressor with a limit switch located by application of the method of the subject invention.

The combination of a thermal limiter switch 10 and compressor 12 in an air conditioning unit of a vehicle is generally illustrated in FIG. 1. Operation of the compressor 12 is belt driven off the crank shaft through the compressor clutch pulley 16. The rotation of the clutch pulley 16 is transferred to the compressor 12 only when the compressor clutch 18 is engaged, which is accomplished when current flows through the compressor clutch coil 20. As commonly known in the art, the compressor 12 compresses the low pressure refrigerant vapor into a high pressure high temperature vapor which is thereafter transferred to the condenser. Other compressors are not using a clutch to engage the compressor with the drive mechanism. As long as electricity is used to modulate pumping capacity between 0 and full ouput the proposed method of use of a thermal limiter switch can be used to protect the compressor from failure. Electric cars will use electrically driven and controlled compressors. The thermal limiter use and its method of placement for optimum performance can be used to provide compressor protection from failure.

The thermal limiter switch 10 interconnects power to the electromagnetic clutch 18 via the coil 20 to other controls or to the electric motor driving the compressor. The limiter switch 10 is be connected in either the supply or return power conductor 21, 23 of the compressor 12. The thermal limiter switch 10 has an open condition preventing current to flow therethrough to the clutch coil 20 and to electrical controls or to the electric motor driving the compressor thereby preventing operation of the compressor 12 and a close position allowing current to flow to the clutch coil 20 allowing engagement of the electromagnetic clutch 18 with the compressor 12 and operation of electric controls or the electric motor driving the compressor. The thermal limiter switch 10 senses temperature and moves to its open condition when the sensed temperature is greater than a cut-out temperature, and moves to its closed position when the sensed temperature decreases to less than a cut-in temperature thereby indicating normal operation.

The positioning of the limiter switch 10 on the compressor 12 is important to provide protection in the case of overheating. Such overheating and therefore abnormal operation may occur due to any of the following: loss of charge; resistive mechanical failure, such as bad rings or improper tightening; and in some compressors, due to failed thermostat expansion valve (TXV). Each of these failures cause increased heating of the compressor 12 which may be sensed to indicate abnormal operation thereof. The limiter switch 10 is fastened to the compressor 12 at a location where heat build-up rate is maximum.

Figure 2:
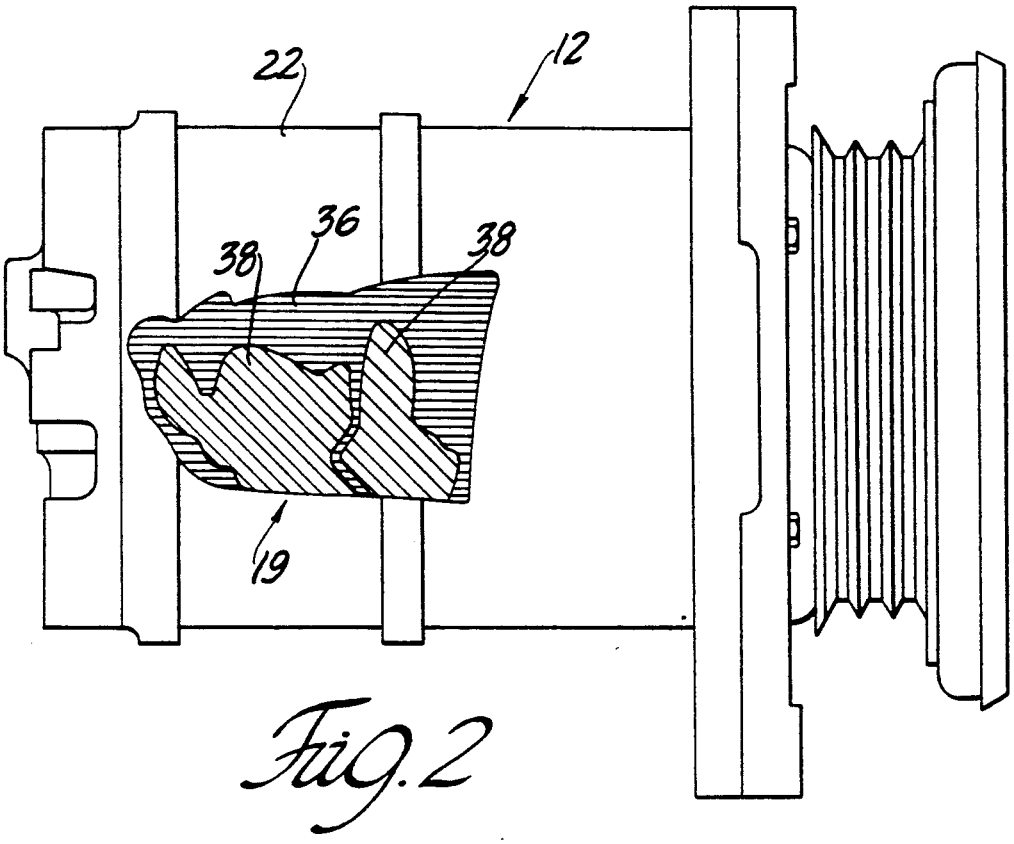
FIG. 2 is a thermographic display of the compressor in normal operating conditions.
Figure 3:
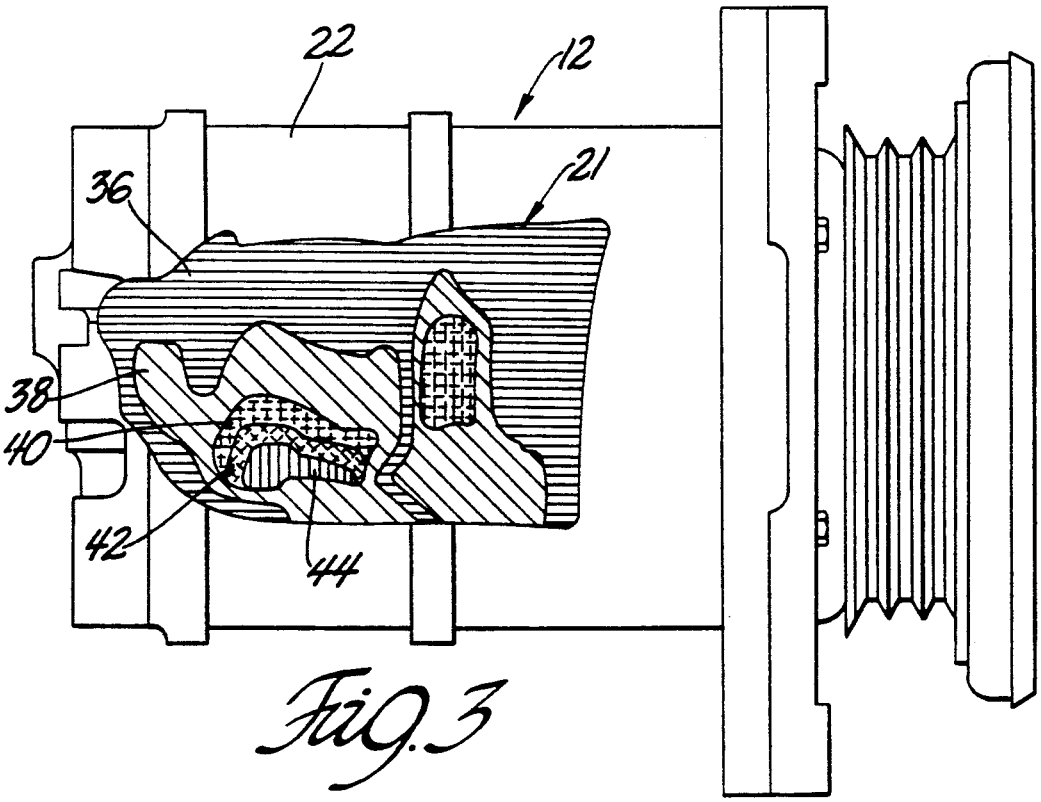
FIG. 3 is a thermographic display of the compressor under abnormal operating conditions.

Infrared thermography is used to detect failure modes before actual failure occurs. Thermography allows the monitoring of extremely hot areas on compressors 12 which occur when subjected to failure or abnormal mode conditions, such as loss of refrigerant. FIGS. 1-3 illustrate the application of the method on a compressor 12 manufactured by General Motors, Harrison Division, of the type HR-6.

The method of determining location or placement of the limiter switch 10 on the compressor 12 includes an initial step of measuring and graphing the normal and abnormal thermal condition of heat up and cool down. A thermographing device, such as infrared camera equipment by Hughes, provides a photograph of the thermograph or a CRT screen display. The compressor 12 is operated under normal operating conditions with no failures and a normal thermograph 19 is produced by taking a picture of the external compressor 12 and external housing 22 thereof, as illustrated in FIG. 2. Thereafter, failure or abnormal operation is simulated in the compressor 12 by either eliminating charge, creating excessive mechanical friction, etc. An abnormal thermograph 21 is produced of the external surface of the compressor 12 as illustrated in FIG. 3. Based on the thermographics 19, 21, an optimum sensing spot may be identified for each compressor type. The abnormal and normal graphs 19, 21 are compared to one another to determine the location of a thermal differential. The blue area 36 represents 200°-220°, green 38 represents 220°-270°, yellow 40 represents 270°-300°, orange 42 represents 300°-320°, and red 44 represents 320°-360°. This location is identified by a large differential, typically 100° to 150° gradient, i.e., the red area 44. The location of this differential is dependent upon the design or type of the compressor 12. Such dependency depends on gas passages, resistive mechanics, etc. It is desirable to place the limiter switch 10 at this location on the housing of the compressor 12, as illustrated in FIG 1. It has been determined by the above method that the optimum location of the limit switch 10 is opposite the inside gas crossover passage in the case of the HR-6 type Harrison Division Compressor.

Figure 8:
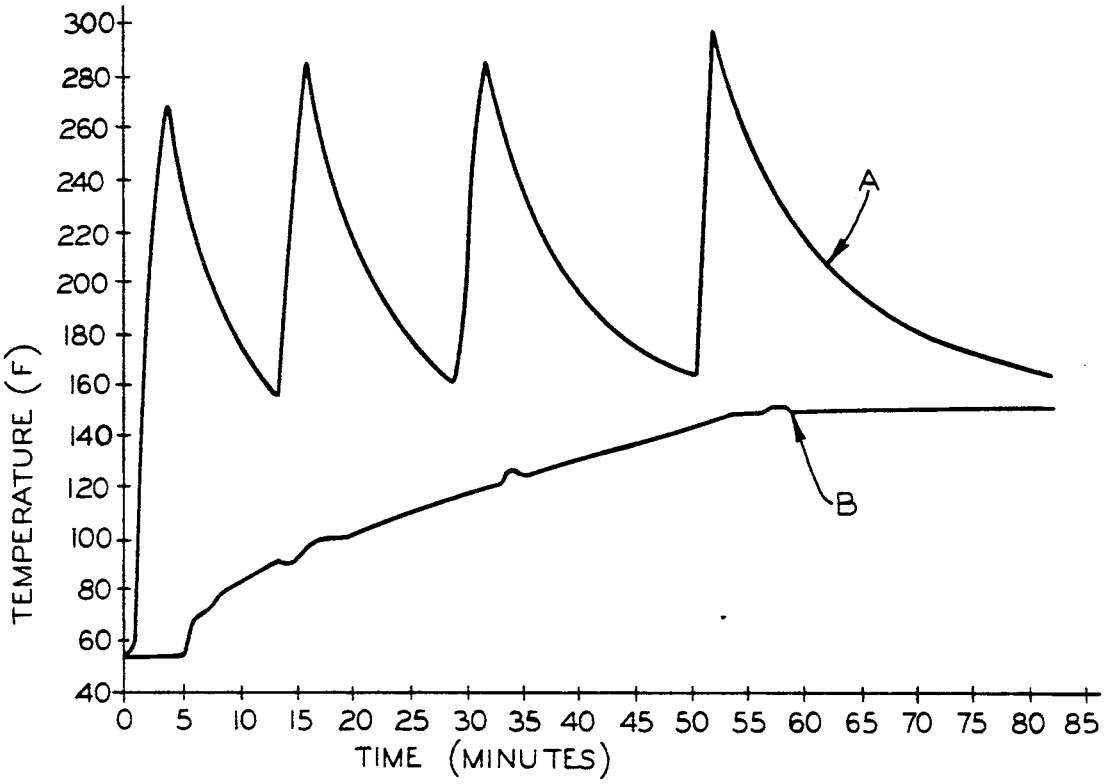
FIG. 8 illustrates the cut-out and cut-in curve of the switch.

With regard to the limiter switch 10, a bimetal snap acting disc sold by Texas Instruments, Klixon 7AM thermal protector, is suitable. Alternatively, a thermistor or other type of sensor may be used. The limiter switch 10 allows for a differential between the cut-out temperature and the cut-in temperature of approximately 100° F. As illustrated in FIG. 8, the cut-in is set at 160° and the cut-out is set at 260° . This differential allows the operator of the vehicle to detect the loss of performance of the air conditioning unit, yet adequately protect the compressor 12 by assuring sufficient cool down before resuming operation. The limiter switch 10 is normally closed and conducts current to the compressor clutch 18. If the temperature on the housing of the compressor 12 increases past the cut-out temperature, the switch 10 is opened.

Compressor 12 operating temperature is limited to below a certain temperature corresponding to switch cut-out temperature setting. After the temperature cools to a certain temperature, corresponding to the reset point of the limiter switch 10, the switch 10 cuts in and compressor 12 operation resumes. As illustrated in FIG. 8, line A represents the temperature of the housing 22 of the compressor 12, and line B indicates the ambient temperature around the compressor 12. The positive and negative peaks of line A represent the cut-out and cut-in temperatures as inhibited by the switch 10.

The limiter switch 10 may be connected to the compressor 12 against the outer housing surface 22 thereof as illustrated in FIG. 1. The limiter switch 10 may be mechanically attached by any mechanical connector, as commonly known in the art, such as fasteners 25. The limiter switch 10 must be environmentally and electrically protected. An epoxy coating 24 may be utilized to coat the limit switch 10 to electrically insulate the switch 10 from the compressor housing 22.

Figure 6:
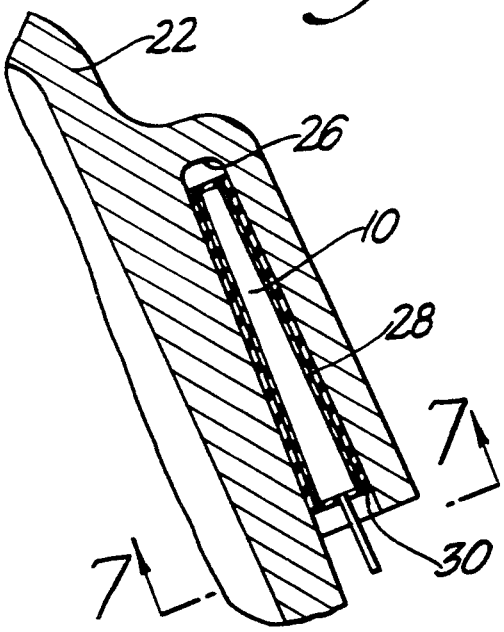
FIG. 6 is a cross-sectional view of the connection of the limiter switch.
Figure 7:
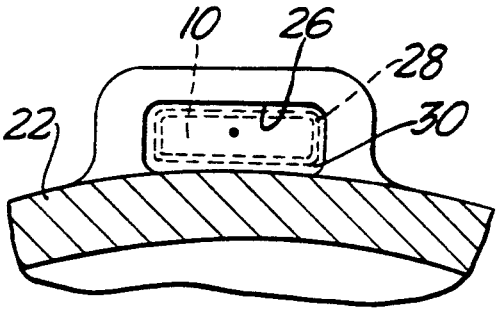
FIG. 7 is a view taken along lines 7—7 of FIG. 6.

Alternatively, a cavity 26 may be formed in the compressor housing 22 within which the limit switch 10 is inserted as illustrated in FIGS. 6 and 7. An electrical shrink wrap material 28, i.e., nylon, is placed about the switch 10 to electrically insulate the same from the compressor 12. Thereafter, the switch 10 is placed within the cavity 26 and injection sealed therein with a rubberized material 30.

Figure 4:
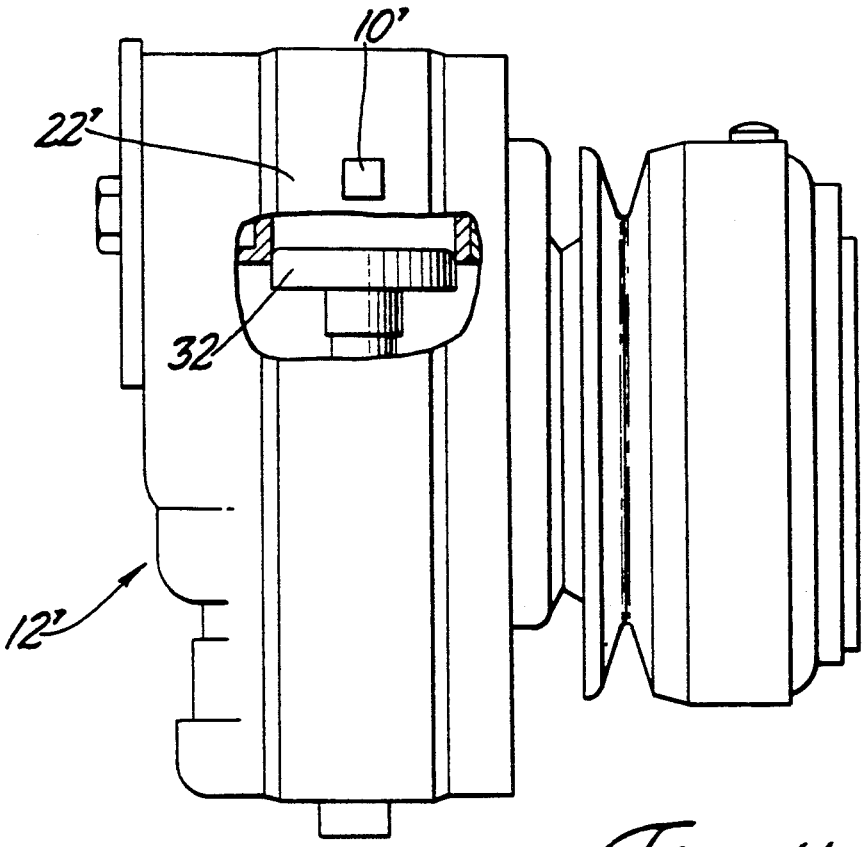
FIG. 4 illustrates location of the sensor on a second type of compressor.

FIG. 4 illustrates a compressor of the type R4 manufactured by General Motors, Harrison Division, with the limit switch 10', directly above one of its radial pistons 32 on the outside surface 22', of the shell of the compressor 12'.

Figure 5:
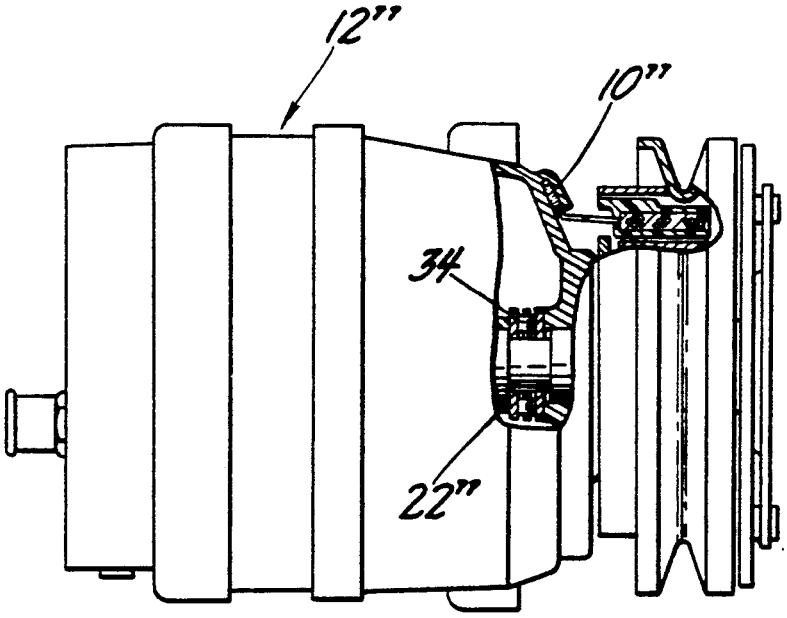
FIG. 5 illustrates location of the sensor on a third type of compressor.

FIG. 5 illustrates a compressor of the type V5 manufactured by General Motor's, Harrison Division, with the limit switch 10'' on the front face surface of the body 22'' mounted opposite the thrust bearing 34. In this case, the limit switch 10'' may also protect against overheating caused by the clutch slippage or impending bearing failure.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A method of positioning a limit switch on a compressor for measuring the temperature of the compressor allowing operation of the compressor during normal operation when the temperature thereof is less than a cut-in temperature and preventing operation of the compressor during abnormal operation when the temperature thereof is greater than a cut-out temperature, the method including the steps of:

operating a compressor near failure mode, measuring external thermodynamics of the compressor for establishing a thermal differential location, positioning the limit switch at the thermal differential location to prevent operation of the compressor during abnormal operation of the compressor.

2. A method as set forth in claim 1 further including measuring the normal external thermodynamics of a compressor during normal operation.

3. A method as set forth in claim 1 further including thermographing the normal thermodynamics for the compressor during normal operation for producing a normalized thermograph.

4. A method as set forth in claim 3 further including thermographing the abnormal thermodynamics for the compressor during abnormal operation for producing an abnormal thermograph.

5. A method as set forth in claim 4 further including comparing the abnormal thermograph to the normal thermograph to identify high temperature gradients indicating the differential location.

6. A method as set forth in claim 5 further including photographing the normal thermograph.

7. A method as set forth in claim 6 further including photographing the abnormal thermograph.

* * * * *